United States Patent [19]

Layton

[11] Patent Number: 4,718,790

[45] Date of Patent: Jan. 12, 1988

[54] PAVER WITH ROTATING DISC FLOOR

[76] Inventor: Jack D. Layton, 4468 Medina La. SE., Salem, Oreg. 97301

[21] Appl. No.: 12,299

[22] Filed: Feb. 9, 1987

[51] Int. Cl.[4] ..... E01C 19/48

[52] U.S. Cl. ..... 404/101; 404/108

[58] Field of Search ..... 404/101, 105, 106, 108, 404/110; 222/236, 237, 241; 414/501, 502, 526; 239/672; 198/308.1

[56] References Cited

U.S. PATENT DOCUMENTS

| | | | |
|---|---|---|---|
| 1,110,457 | 9/1914 | Peoples | 414/507 |
| 1,261,241 | 4/1918 | Jones | 414/507 |
| 2,005,896 | 6/1935 | Hurt | 404/108 X |
| 3,099,369 | 7/1963 | Schatz et al. | 222/238 |
| 3,306,501 | 2/1967 | Keller | 222/328 |
| 3,417,851 | 12/1968 | Gonski et al. | 198/308.1 |
| 3,561,681 | 2/1971 | Tyler | 239/663 |
| 3,699,855 | 10/1972 | Leister | 404/108 |
| 3,771,893 | 11/1973 | Miller | 404/101 |
| 3,967,912 | 7/1976 | Parker | 404/108 X |
| 4,145,154 | 3/1979 | Mingot | 404/108 X |
| 4,193,523 | 3/1980 | Koning | 222/254 |
| 4,302,127 | 11/1981 | Hodson | 404/108 X |

*Primary Examiner*—James A. Leppink
*Assistant Examiner*—Matthew Smith
*Attorney, Agent, or Firm*—Kolisch, Hartwell & Dickinson

[57] ABSTRACT

A paver for spreading aggregate over a surface. The paver includes a collecting hopper for receiving material from a dump truck. Rotating discs form a portion of the floor of the collecting hopper, and on operation of the discs aggregate is moved to cascade from a rear edge of the collecting hopper into a feed hopper. Material flows from the feed hopper to a region in advance of a screed in the paver. The collecting hopper is tiltable fully to clean aggregate therefrom.

10 Claims, 4 Drawing Figures

PAVER WITH ROTATING DISC FLOOR

BACKGROUND AND SUMMARY OF THE INVENTION

This invention relates to so-called pavers or finishers, of the type adapted to receive aggregate, such as a mixture of crushed rock and asphalt, and then to spread such aggregate as a smooth layer over a surface being paved. In the usual instance, aggregate is supplied to the paver through a dump truck positioned in front of the paver, which dumps aggregate from the dump body of the truck into a receiving hopper provided in the paver.

With larger units having a receiving hopper of appreciable size, problems are experienced in moving the aggregate within the hopper whereby such may fall from the hopper downwardly toward the region being paved and in advance of the screed in the paver which is the instrumentality which smooths and spreads the material on the surface being paved. If the hopper is made tiltable to cause material by gravity to flow downwardly in advance of the screed, problems arise in connection with the dump truck which is supplying the paver. Further explaining, clearance problems arise, with the hopper being tilted, tending to move into the dump body of the truck. This has required what may be referred to as "jack-rabbitting", with the truck having to move forwardly and free of the paver to permit tilting of the hopper, and the truck after the hopper is lowered moving back into proper dumping position to permit dumping of more of its load into the dump body. This obviously is time-consuming and tedious. Alternatively, a conveyer such as a drag chain may be provided along the base of the hopper. However, such are difficult to clean and the return run of the drag chain which of necessity travels under the hopper tends to draw material with it and away from the specific region where paving is being performed. Additionally, it is difficult to accurately control material flow where drag chains are present, since the presence of the chain makes it difficult to incorporate any closure structure operable to prevent material flow at the precise time desired.

In general terms, an object of the invention is to provide a novel paver or finishing machine which takes care of the above and related problems in a highly practical and satisfactory manner.

More specifically, an object of the invention is to provide a paver which includes one, preferably two, rotating discs forming a substantial portion of the floor of the paver which may be operated to produce rearward flow of aggregate to a region where such may cascade downwardly in advance of the screed in the paver.

A somewhat related object is to provide such a paver which, in addition to the discs, includes a tiltable mounting with the hopper being tiltable to cause material by gravity to flow rearwardly and out of the hopper. With the organization contemplated, the discs may be employed to cause rearward movement of much of the load of the dump truck, and to the extent necessary to permit the truck to dump its entire load into the hopper without losing its closely coupled relation with the paver. With the entire load dumped and the truck moved away to receive another load, the hopper may be pivoted completely to clear it of the aggregate supplied by the truck, with the hopper being fully cleared when subsequently lowered to receive aggregate dumped from another truck.

Another object and feature of the invention is the provision of a paver which includes, in effect, a pair of hoppers, comprising a main or collecting hopper which receives material from the dump truck, and another, what is referred to herein as a "feed hopper", which receives material moved from the collecting hopper and controls the flow of such directly in advance of the screed in the paver. With disc means forming the floor of the collecting hopper, the feed hopper may be constructed so as completely to confine material moved from the collecting hopper. Through appropriate control of closure means forming the base of the feed hopper, the amount of material deposited for leveling by the screed may be precisely controlled.

A paver as contemplated herein is relatively easily cleaned and presents minimal maintenance problems. Readily incorporated with the paver are so-called screed extensions and other devices, such as augers, promoting enlarging of the side-to-side dimension of the layer of material spread by the screed, and a uniform distribution of material in a region in advance of the screed.

Another feature and object of the invention is the provision of a novel mounting for the screed in a paver, permitting adjustments to be made in the angle spreading surface of the screed assumes with respect to the area being paved.

These and other objects and advantages are attained by the invention, which is described hereinbelow in conjunction with the accompanying drawings, wherein.

Figure 1:
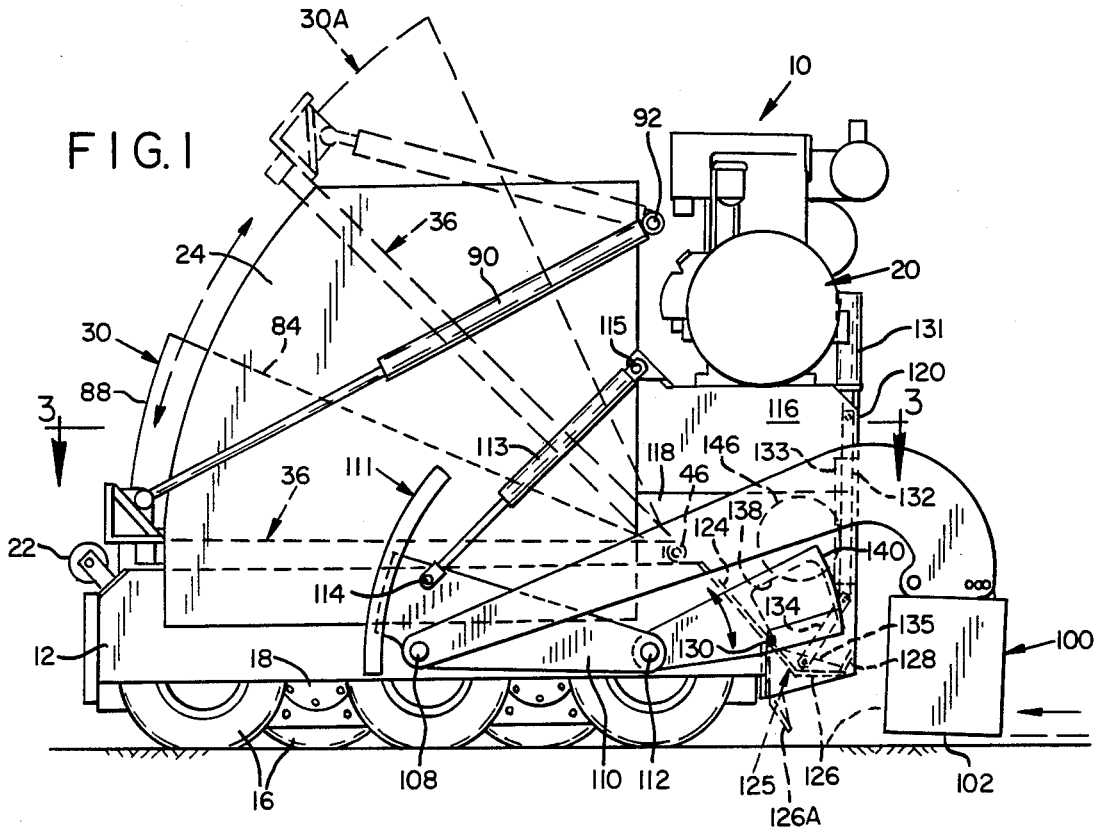
FIG. 1 is a side elevation illustrating a paver as contemplated.

Referring now to the drawings, and more particularly to FIG. 1, a paver or finisher is shown generally at 10. In use, the paver trails a dump truck traveling in front of the paver and operates to collect and then spread, in a layer, aggregate poured from the truck into the paver. In FIG. 1, the front of the paver is shown at the left and the rear of the paver is shown at the right. In this description, the longitudinal axis of the paver is construed as extending in the direction that the paver travels.

The paver illustrated includes a frame 12. Mounted on the frame, and supporting the paver for movement over the ground, are wheels (or ground-traveling means) illustrated at 16. In a preferred embodiment and in the embodiment illustrate, the paver is self-propelled unit, in that such is powered under its own power during the paving operation (as compared to a towtype paver which is coupled to the dump truck and which is towed by the truck while paving proceeds). Toward these ends, the wheels 16 are power-driven by means including the drive transmission partially shown at 18. Powering the drive transmission are conventional hydraulic motors (not shown) provided with fluid under pressure from a supply including an internal combustion engine and pump assembly, shown at 20, mounted on frame 12 in an elevated position adjacent the rear of the paver.

As is usual with self-propelled pavers, during the paving operation, and while receiving aggregate, such travels in trailing relation behind a dump truck which contains the aggregate in the body of the dump truck. Rollers, such as the roller shown at 22 rotatably mounted on the paver frame, engage the rear wheels of the dump truck, thus to establish the proper trailing relationship of the paver to the dump truck.

Figure 3:
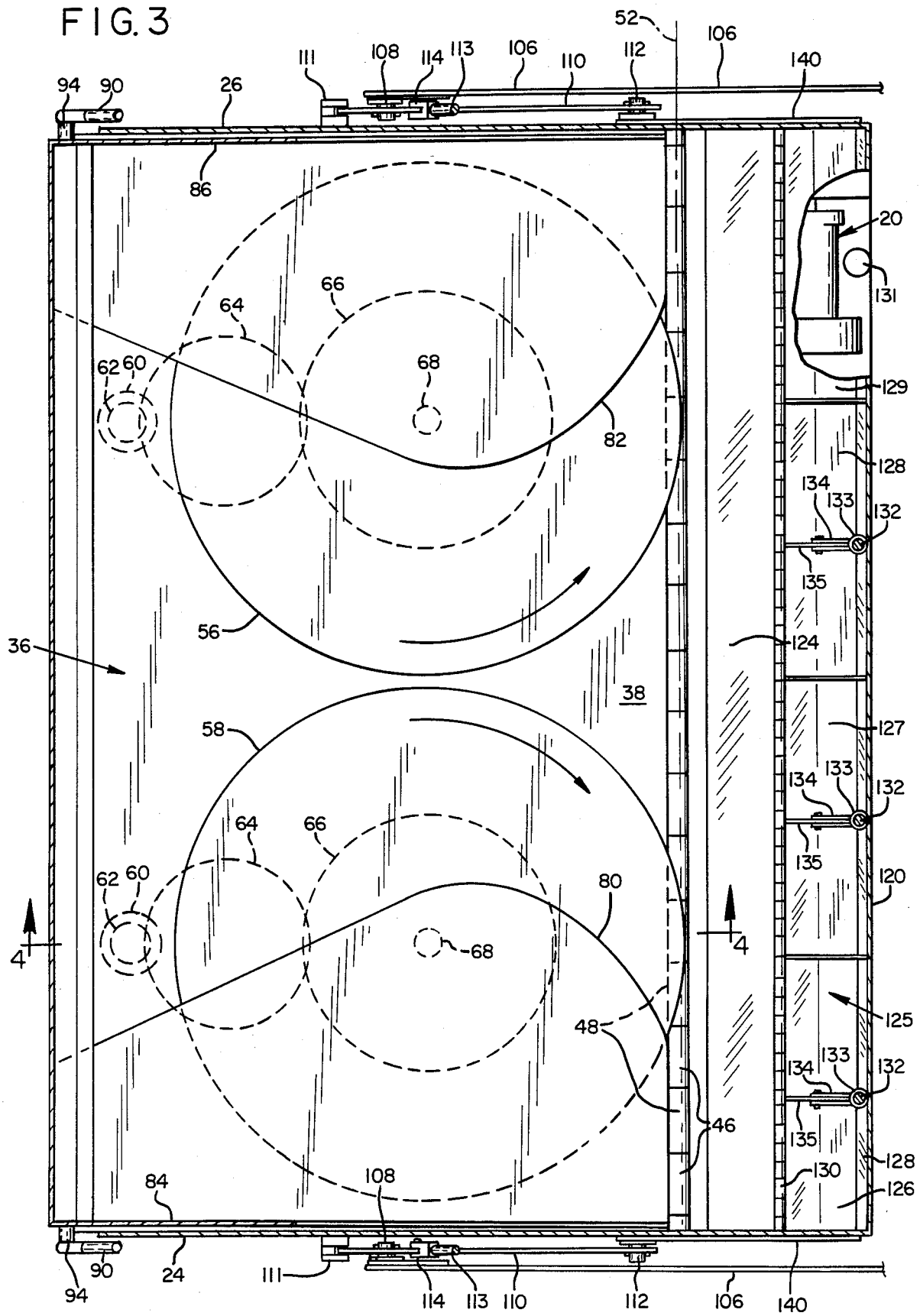
FIG. 3 is a view, on a somewhat enlarged scale, viewing the floor of a collecting hopper in the paver, as such would appear in a view taken along the line 3—3 in FIG. 1.

The paver includes, and referring to FIGS. 1 and 3, side walls 24, 26 which are secured to the frame of the paver in an upright position. What is referred to herein as a collecting hopper is mounted on the paver in the spaced bounded these side walls. The collecting hopper has been given the general reference numeral 30 in the drawings.

Collecting hopper 30 includes a panel assembly 36, which in plan has a substantially rectangular configuration. As probably best illustrated in FIG. 4, the top of the panel assembly is provided by a sheet 38 and forming the bottom of the panel assembly is a sheet 40. These are suitably secured to an inner bracing framework 42, whereby the sheets and framework form a rigid unit.

Figure 4:
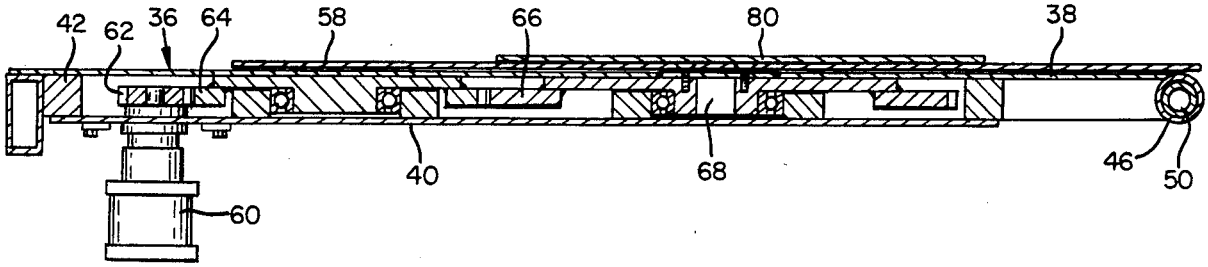
FIG. 4 is a cross-sectional view taken along the line 4—4 in FIG. 3.

Suitably secured in the panel assembly, along the right edge thereof, as such is viewed in FIGS. 3 and 4, are sleeve segments 46. The sleeve segments are located at spaced intervals along this edge of the panel assembly and have interspersed therewith sleeve segments 48 which are secured to the paver frame. The sleeve segments 46, 48 receive an elongate pin 50 whereby a piano-type hinge is provided hingedly or pivotally connecting the panel assembly to the paver frame. The pivot axis provided by this hinge assembly extends horizontally and transversely of the paver, adjacent the rear edge of the panel assembly and has been given the reference numeral 52 in FIG. 3.

Considering further the construction of the collecting hopper, and as illustrated in FIGS. 3 and 4, overlying sheet 38 forming the top of the panel assembly and rotatably mounted on the panel assembly are a pair of flat discs 56, 58. These have, as shown, substantially the same diameters and are disposed side-by-side in a direction extending transversely of the paver. Rear margins of the respective discs overlay and are adjacent the rear edge of panel assembly 36.

Means is provided for rotating each of the discs under power with the discs actuating in opposite directions. Specifically, and referring to disc 58 as illustrated in FIGS. 3 and 4, suitably secured to the underside of panel assembly 36 is a hydraulic motor 60 supplied with pressurized hydraulic pressure fluid from the engine and pump assembly 20. The output shaft of roller 60 is secured to a pinion gear 62 suitably mounted within the interior of panel assembly 36. The teeth of pinion gear 62 mesh with the teeth of an idler gear 64 suitably journaled within the panel assembly. In turn, the teeth of gear 64 mesh with the teeth of a bull gear 66 suitably journaled within the panel assembly. The bull gear is suitably nonrotatably secured to a stub shaft 68 extending from plate 58.

A similar drive system comprising a hydraulic motor and gears 72, 74, 76 is provided for the purpose of driving under power disc 56.

Disc 58 is partially overlaid by a shield plate 80 suitably rigidly supported in the collecting hopper and extending from one side of the hopper. A similar shield plate 82, on the other side of the hopper, overlies a portion of disc 56. The shield plates cover side margins of the discs where such side margins are moving away from the rear edge of panel assembly 36.

Completing the description of the collecting hopper, forming the sides of the hopper are hopper sides 84, 86, each having an approximately triangular configuration as such is viewed in FIG. 1. These are suitably rigidly secured to the panel assembly in positions paralleling and closely adjacent respective side walls 24, 26.

The end of the collecting hopper which faces forwardly in the paver is closed off by hopper end wall 88.

The collecting hopper has a lowered position, as shown in FIG. 1, where panel assembly 36 extends horizontally with the panel assembly supported by the paver frame. The hopper is tiltable by pivoting such about the pivot axis provided by sleeve segments 46 to the raised position indicated in dashed outline at 30A in FIG. 1. In this position, the panel assembly and the disc plates which overlie it occupy sharply inclined positions.

A power-operated means is provided for tilting the collecting hopper and adjustably positioning it between these two extreme positions described. More specifically, such comprises an extensible-contractible ram 90, having its cylinder 90 pivotally connected at 92 to a side wall of the paver and its rod end pivotally connected at 94 to the collecting hopper adjacent the end thereof which faces forwardly in the paver. If desired, another similar ram may be provided for raising the hopper associated with the side wall of the paver which is obscured from the viewer in FIG. 1, i.e., the side wall in the paver on the opposite side of the paver from the side shown in FIG. 1.

From the above description, it should be apparent that a substantial portion of the floor of the collecting hopper is formed by the exposed portions of the rotating discs 56, 58. During operation of the paver and to produce movement of the material toward the rear edge of the collecting hopper, the discs are rotated in the directions of the arrows shown in FIG. 3 (i.e., the upper disc in a counterclockwise direction and the lower disc in a clockwise direction), such movement tending to carry aggregate rearwardly in the hopper toward the rear edge thereof.

Figure 2:
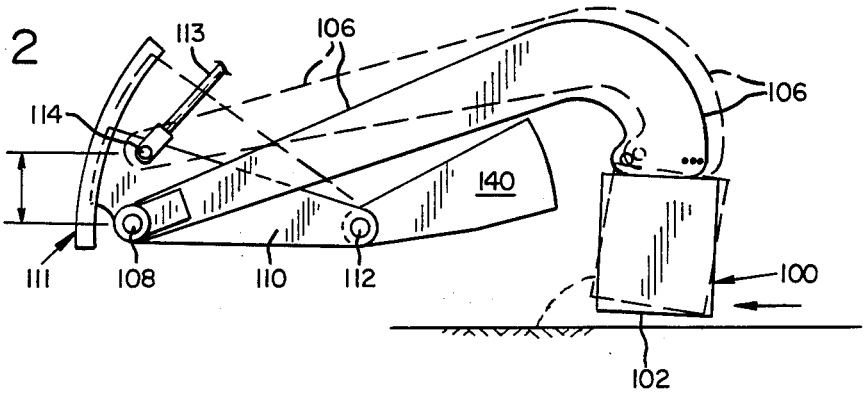
FIG. 2 is a side elevation of a screed assembly in the paver shown in FIG. 1 and, illustrating in dashed outline, an adjusted position for the screed assembly.

Further considering the construction of the paver, pulled by the paver in trailing relation to the hopper just described is what is referred to as a screed assembly shown at 100. Such comprises an elongate structure extending transversely of the paver bottomed by a surface 102 which functions to level off and smooth aggregate placed in advance of the screed assembly as the paver moves forwardly along the area being paved. The screed assembly is supported on opposite sides of the paver by an elongate arm, such as the one shown at 106 in FIGS. 1 and 2. The rear end of this arm is suitably mounted on the screed assembly whereas the front end is pivotally supported by pivot means 108 on an adjustable mounting are 110. Mounting arm 110 is pivotally mounted by pivot means 112 on the frame of the paver. The free end of arm 110 is guided for arcuate movement by guide 111 suitably secured to a side of the paver. As illustrated in FIG. 2, with mounting arm 110 raised from the position shown in solid outline to the position shown in dashed outline in the figure, pivot means 108 is raised, and such serves to adjust the inclination of surface 102 with respect to the material being spread. Various forms of mechanisms may be provided for raising and lowering mounting arm 110 and holding such in various positions of adjustment. In the device illustrated in FIG. 1, this is performed by providing a fluid-operated ram 113 which has its extensible, rod end pivotally connected at 114 to arm 110 and its cylinder end pivotally connected at 115 to a side of the paver. With contraction of the ram from the position shown in FIG. 1, mounting arm 110 pivots with raising of its free end to change the position of pivot means 108.

Forming a continuation of side wall 24 are plates such as those shown at 116, 118. Similar plates are associated with side wall 26. These plates are suitably fastened to the paver frame. These plates, in conjunction with end wall 120, form a hollow housing structure in the region of the paver located rearwardly of plates 24, 26.

Referring to FIGS. 1 and 3, extending under sleeve segments 46 forming part of the hinge means pivotally mounting the collecting hopper, and thence rearwardly and downwardly in the paver, is a wall 124. This wall, plus the bottom portion of wall 120 which is opposite it, as well as the bottom extremities of plate 118 and the corresponding plate on the other side of the paver, collectively define what is referred to herein as a feed hopper in the paver. The feed hopper has an opening at the top thereof located rearwardly and below the rear edge of panel assembly 36, adapted to collect material fed thereinto which cascades from the panel assembly with such inclined, or which gravitates into the hopper space under the action of rotating discs 56, 58.

Forming a portion of the bottom of the feed hopper, is a wall 128 which extends downwardly and inwardly from end wall 120. Coacting with this wall is gate means 125 comprising multiple gates 126, 127, 128, 129 (see FIG. 3) pivotally mounted on a rod or pin 130 extending transversely of the paver. Each of these gates is provided with power-operated means for pivoting the gate between raised and lowered positions, as illustrated by the raised position shown for a gate 126 in FIG. 1 in dotted outline, and the lowered position shown for this gate in FIG. 1 in dashed outline at 126A. Specifically, such mechanism includes, and as illustrated for gate 126, a fluid-operated extensible ram 131 having a cylinder end suitably mounted on the paver and its rod end connected to a slide element 132 supported for vertical reciprocal movement in a guide 133. The bottom end of the slide element is pivotally connected to links 134 which have their opposite ends pivotally connected to an ear bracket 135 secured to gate 126. With the construction described, and on extension of ram 131, gate 126 is swung to move its nonpivoted edge downwardly from wall 128. The other gates in the gate means are provided with similar rams and are similarly adjusted in position.

In some instances, it may be desirable to produce a spreading of material in a swath which is wider than the side-to-side dimension of the paver. In this instance, the screed assembly is constructed with screed extensions whereby its length may be adjusted to one extending to some extent outwardly from opposite sides of the paver. Aggregate is conveyed outwardly from the ends of the feed hopper through openings provided in plate 118 on one side of the paver and the corresponding plate on the opposite side of the paver, the opening for plate 118 being indicated at 138. Such opening normally is closed by a closure plate 140 which is pivotally mounted through pivot means 112 on the paver. The plate in FIG. 1 occupies a position closing opening 138 but may be swung upwardly about pivot means 112 to open up opening 138.

With the paver equipped to produce leveling with screed extensions and to promote movement of material out through the openings 138, it may be desirable to include in the feed hopper, adjacent its top, an elongate auger, or similar device, extending transversely of the paver and rotated under power to produce lateral movement of material. In FIG. 1, the outline for such an auger is shown at 146.

Discussing generally the operation of the paver, during use the paver travels along the area to be paved, receiving aggregate from a vehicle such as a dump truck which dumps aggregate from the dump body of the truck into the collecting hopper. To move material from the collecting hopper, the discs 56, 58 are rotated with rotation causing the aggregate to cascade over the rear edge of the panel assembly into the feed hopper which is provided rearwardly of the collecting hopper in the paver.

After dumping from the dump body of the truck of the last part of its load into the collecting hopper, the dump truck normally moves away from the paver to receive a new load of aggregate and free the space in front of the paver for another dump truck. To finally and completely clear the collecting hopper of aggregate at this time, the collecting hopper is tilted utilizing rams 90 whereby the entire contents of the collecting hopper moves into the feed hopper. The collecting hopper may then be lowered to place it in a condition for receiving aggregate from a fully loaded dump truck.

During paving, gates 126, 127, 128, 129 are actuated as desired to control flow of material immediately in advance of the screed 100. With the gates moved to a closed position closing off the base of the feed hopper, and because of the confinement offered to the flow of the material from the paver by the feed hopper, close control of material flow is provided essentially eliminating any waste of material dumped in front of the screed.

The paver is relatively easily cleaned. Absent in the paver is any return run of a conveyor system introducing cleaning and material flow-control problems.

While a preferred embodiment of the invention has been described herein, modifications and variations are possible without departing from the scope of the invention as herein contemplated.

It is claimed and desired to secure by Letters Patent:

1. In a paver which includes a collecting hopper for collecting aggregate dumped thereinto from a supply of aggregate:

a screed mounted on said paver and extending transversely of the paver and spaced longitudinally from said collecting hopper;

an elongate opening defined in the paver which is substantially parallel to and spaced from the screed for feeding aggregate in advance of the screed;

a rotary disc forming a portion of the floor in said collecting hopper rotatable about an upright axis and having a margin thereof disposed above and adjacent said opening, the disc being operable on rotation to move aggregate located in the hopper hopper toward said opening, and an elongate feed hopper mounted on said paver substantially paralleling said screed and in advance of the screed, said opening forming formed in the top of said feed hopper.

2. The paver of claim 1, wherein said feed hopper includes adjustable closure means forming the base of the feed hopper which is adjustable between positions opening and closing off the base of the feed hopper.

3. The paver of claim 1, which further includes another rotary disc forming another portion of the floor of said collecting hopper rotatable about an upright axis, said first-mentioned and said other discs being located side-by-side in a direction extending transversely of the hopper, and which further includes power-operated means for rotating the discs in opposite directions.

4. The paver of claim 1, wherein said screed is spaced to the rear of the collecting hopper and the hopper has a rear edge paralleling and adjacent said elongate opening and which further includes pivot means pivotally mounting said hopper for pivotal movement about a horizontal pivot axis extending transversely of the hopper and adjacent said rear edge.

5. In a paver:

a frame and ground-traveling means for supporting the frame for movement over the ground;

a collecting hopper mounted on said frame for collecting aggregate dumped thereinto from a supply, said hopper having a rear edge extending transversely of the paver;

means pivotally mounting said hopper for adjustable pivotal movement about a horizontal pivot axis extending transversely of the paver and adjacent the rear edge of the hopper;

a pair of side-by-side rotating discs forming a portion of the floor of the hopper rotatable about upright axes and having respective margins located adjacent the rear edge of the hopper and said pivot axis;

power-operated means carried by the hopper for pivotal movement therewith for rotating the discs; and power-operated means for pivoting and thus adjusting the position of said hopper.

6. The paver of claim 5, which further includes an elongate feed hopper disposed immediately rearwardly of and below the rear edge of the collecting hopper, said feed hopper having an elongate opening forming the top thereof facing upwardly and adjacent the rear edge of the collecting hopper, said feed hopper further having adjustable means adjustable between positions opening and closing the bottom of the feed hopper.

7. The paver of claim 6, which further includes an elongate screed for leveling aggregate disposed in a position trailing said feed hopper, and means mounting said screed on said paver frame, said screed having a bottom leveling surface and the means mounting said screed including adjustable means for adjusting the plane of said leveling surface.

8. A paver comprising:

a frame, and ground-traveling means supporting the frame for movement over the ground;

opposed upstanding side walls mounted on said frame forming opposite sides of the paver;

a collecting hopper mounted on said frame between said opposed side walls for collecting aggregate dumped thereinto from a supply, said collecting hopper having a pair of opposed hopper sides forming opposite sides of the collecting hopper extending upwardly snugly adjacent respective ones of said side walls of said paver, said hopper further having a floor terminating in a rear edge extending transversely of the hopper;

means pivotally mounting said collecting hopper for adjustable pivotal movement about a horizontal pivot axis extending transversely of the paver adjacent said rear edge of the floor of the hopper;

said floor of the hopper being partially formed by a pair of side-by-side rotatable discs rotatable about upright axes and having respective rear margins located adjacent the rear edge of the hopper floor and said pivot axis;

power-operated means carried by the hopper for pivotal movement therewith connected to the discs for rotating the discs;

power-operated means for pivoting the hopper about said pivot axis and thus adjusting the position of said hopper;

a screed mounted on the paver frame, spaced from and located rearwardly from the rear edge of said floor; and an opening disposed intermediate the rear edge of said floor and said screed through which aggregate cascades on traveling to the surface being paved.

9. The paver of claim 8, which further includes an elongate feed hopper extending transversely of the paver, said opening forming the top of said feed hopper, said feed hopper including closure means for opening and closing the bottom of the feed hopper.

10. The paver of claim 8, wherein said power-operated means for rotating the discs rotates the discs in opposite directions with side margins of the discs moving away from said rear edge, and wherein said floor of the hopper is partially formed by shield plates for the discs covering the said side margins of the discs.

* * * * *